US007334504B2

(12) United States Patent
Liu

(10) Patent No.: US 7,334,504 B2
(45) Date of Patent: Feb. 26, 2008

(54) HIGH TORSIONAL FORCE STRUCTURE OF RATCHET DEVICE

(76) Inventor: Lin-Lang Liu, No. 252, Sec. 2, Yung Pin Rd, Tai Pin City, Taichung Hsien (TW)

( * ) Notice: Subject to any disclaimer, the term of this patent is extended or adjusted under 35 U.S.C. 154(b) by 0 days.

(21) Appl. No.: 11/424,241

(22) Filed: Jun. 15, 2006

(65) Prior Publication Data

US 2006/0219062 A1 Oct. 5, 2006

Related U.S. Application Data

(63) Continuation-in-part of application No. 10/647,175, filed on Aug. 25, 2003, now abandoned.

(51) Int. Cl.
*B25B 13/46* (2006.01)

(52) U.S. Cl. ..... 81/63.2; 81/63

(58) Field of Classification Search ..... 81/63, 81/63.1, 63.2; 192/43.1, 43.2
See application file for complete search history.

(56) References Cited

U.S. PATENT DOCUMENTS 1,428,982 A * 9/1922 Reese ..... 81/63
1,680,515 A * 8/1928 Gormley ..... 192/43.1
2,430,480 A * 11/1947 Pugh ..... 192/43.2
3,269,496 A * 8/1966 Kilness ..... 192/43.2
4,277,989 A * 7/1981 Tracy ..... 81/62
5,157,994 A * 10/1992 Krivec ..... 81/63.2
6,230,591 B1 * 5/2001 Ling et al. ..... 81/63
6,282,993 B1 * 9/2001 Forman et al. ..... 81/63.2
6,543,316 B2 * 4/2003 Daigle et al. ..... 81/63
6,662,687 B2 * 12/2003 Garg ..... 81/63.2
2003/0145688 A1 * 8/2003 I-He ..... 81/63

* cited by examiner

*Primary Examiner*—D. S. Meislin
(74) *Attorney, Agent, or Firm*—Leong C. Lei

(57) ABSTRACT

A torsional force structure of a ratchet device which includes a body having a head portion at an end of the body. The head portion has a space which is composed of a first recess and a second recess. A socket member is fitted in the first recess and having a plurality of teeth. A ratchet member is fitted in the second recess and provided at two ends thereof with two wedge portions configured to be fitted in an angular region between the inner wall of the space and the socket member. When the triggering rod is first adjusted to move the ratchet member to make one of the wedge portions of the ratchet member fit in the angular region and the the socket member is rotated, the wedge portion of the ratchet member will be forced to be tightly fitted in the angular region thereby enabling the socket member to provide a positive rotating force.

5 Claims, 6 Drawing Sheets

HIGH TORSIONAL FORCE STRUCTURE OF RATCHET DEVICE

CROSS-REFERENCE

This application is a continuation-in-part of the co-pending patent application Ser. No. 10/647,175, filed Aug. 25, 2003, now abandoned.

BACKGROUND OF THE INVENTION (a) Field of the Invention

The present invention relates to an improvement in the torsional structure of a ratchet device.

(b) Brief Description of the Prior Art

Referring to FIGS. 1 and 2, the prior art ratchet device 10 generally includes a body 11 having a cavity formed with a first recess 12 and a second recess for receiving a socket member 20 and a second recess 15 for receiving a ratchet member 25. A spring 28 is mounted in the body 11 for pushing the ratchet member 25 against the socket member 20 thereby engaging the teeth 26 of the ratchet member 25 with the teeth 21 of the socket member 20.

When the ratchet member 25 is moved to one side to engage the inner wall of the second recess 15, there will be a displacement between the teeth 26 of the ratchet member 25 and the teeth 21 of the socket member 20 (see FIG. 2), thereby causing damage to ratchet member 25 and the socket member 20 and therefore making the ratchet wrench unable to function properly. In worse case, this drawback is very significant in small ratchet wrenches.

In view of the above, it is an object of the present invention to provide an improvement in the torsional force structure of a ratchet device which can mitigate and obviate the above drawback.

SUMMARY OF THE INVENTION

This invention is related to an improvement in the torsional force structure of a ratchet device.

It is the primary object of the present invention to provide a torsional force structure of a ratchet device which includes a body having a head portion at an end of said body, said body having a space which is composed of a first recess and a second recess, said space being constituted by a first circle and a second circle, a horizontal center line of said first circle having a distance from a horizontal center line of said second circle, said first circle intersecting said second circle at two points which are located between said horizontal center lines of said first and said second circles, both sides of said first and second circles being connected by a tangent which forms an acute angular region between an inner wall of said space and said socket member, a socket member fitted in said first recess and having a plurality of teeth, a ratchet member fitted in said second recess, said ratchet member being a crescent block having an outer side and an inner side, said outer side of said ratchet member having a plurality of cavities for positioning of a triggering rod, said inner side of said ratchet member having a plurality of teeth engageable with said teeth of said socket member, said ratchet member being provided at two ends thereof with two wedge portions configured to be fitted in said angular region between said inner wall of said space and said socket member, an elastic urging means mounted in said space pushing said ratchet member against said socket member thereby engaging said ratchet member with said socket member, said triggering rod being engaged with a top face of said ratchet member for moving said ratchet member, whereby when said triggering rod is first adjusted to move said ratchet member to make one of said wedge portions of said ratchet member fit in said angular region and the said socket member is rotated, said wedge portion of said ratchet member will be forced to be tightly fitted in said angular region thereby enabling said socket member to provide a positive rotating force.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by the way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
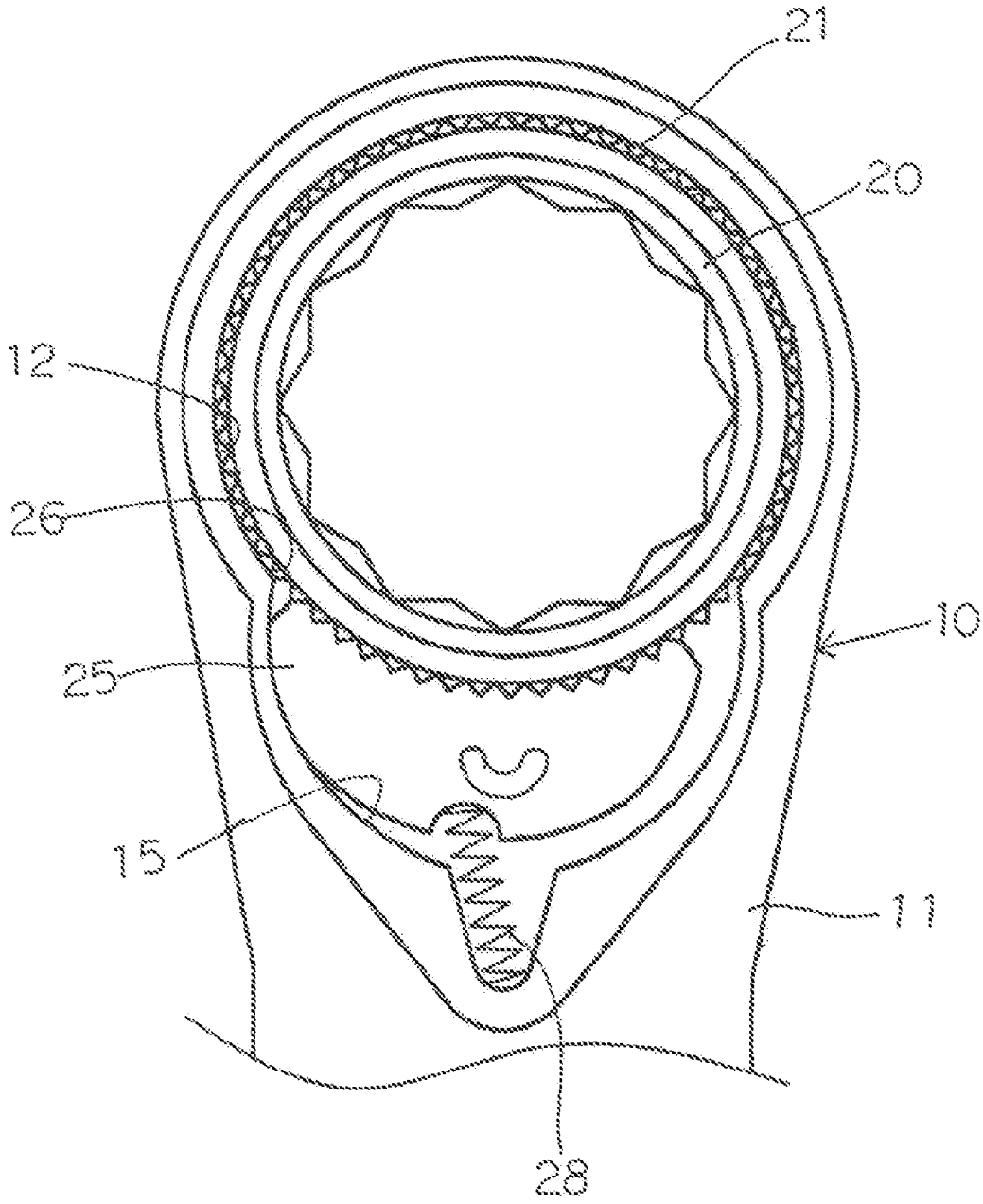
PRIOR ART FIG. 1
FIG. 1 illustrates the structure of a prior art ratchet device.
Figure 2:
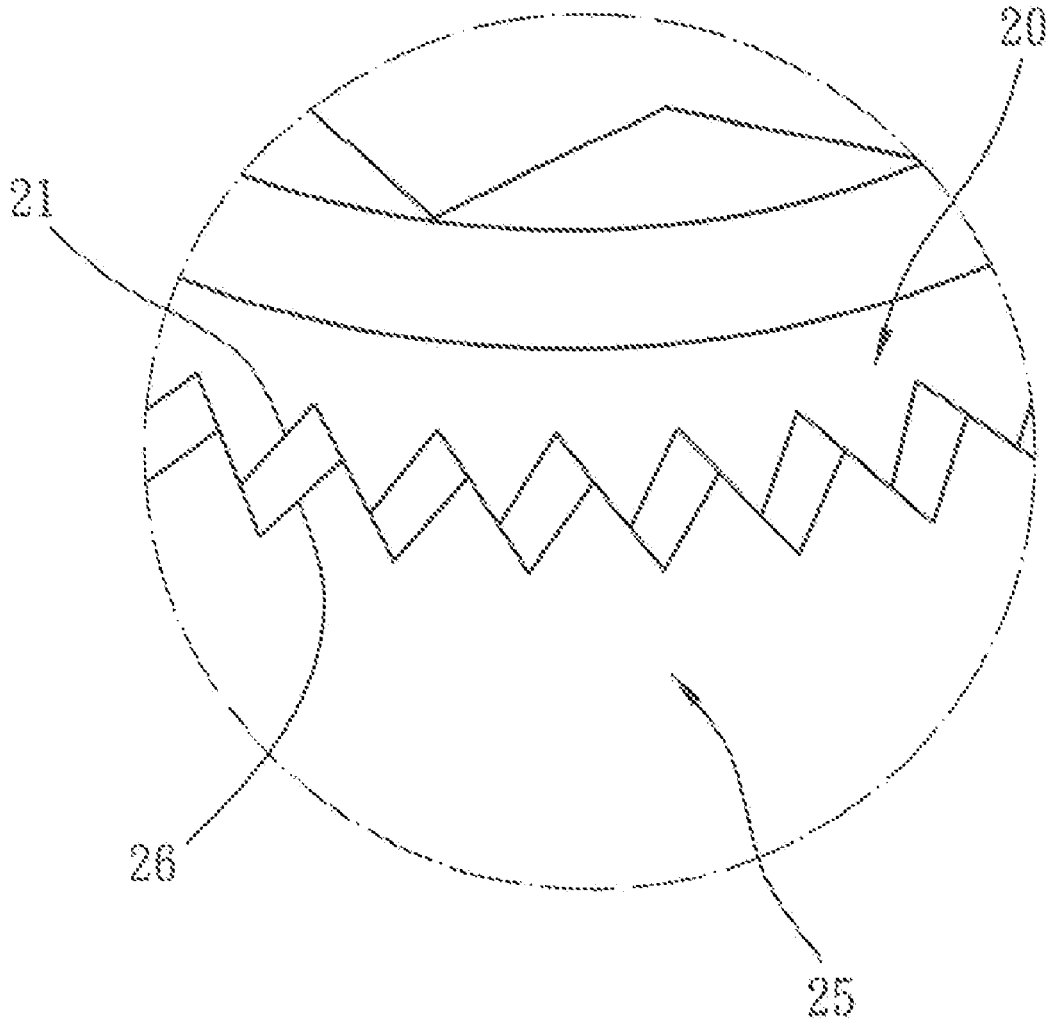
PRIOR ART FIG. 2
FIG. 2 is an enlarged view showing the engagement between the teeth of the socket member and teeth of the ratchet member.
Figure 3:
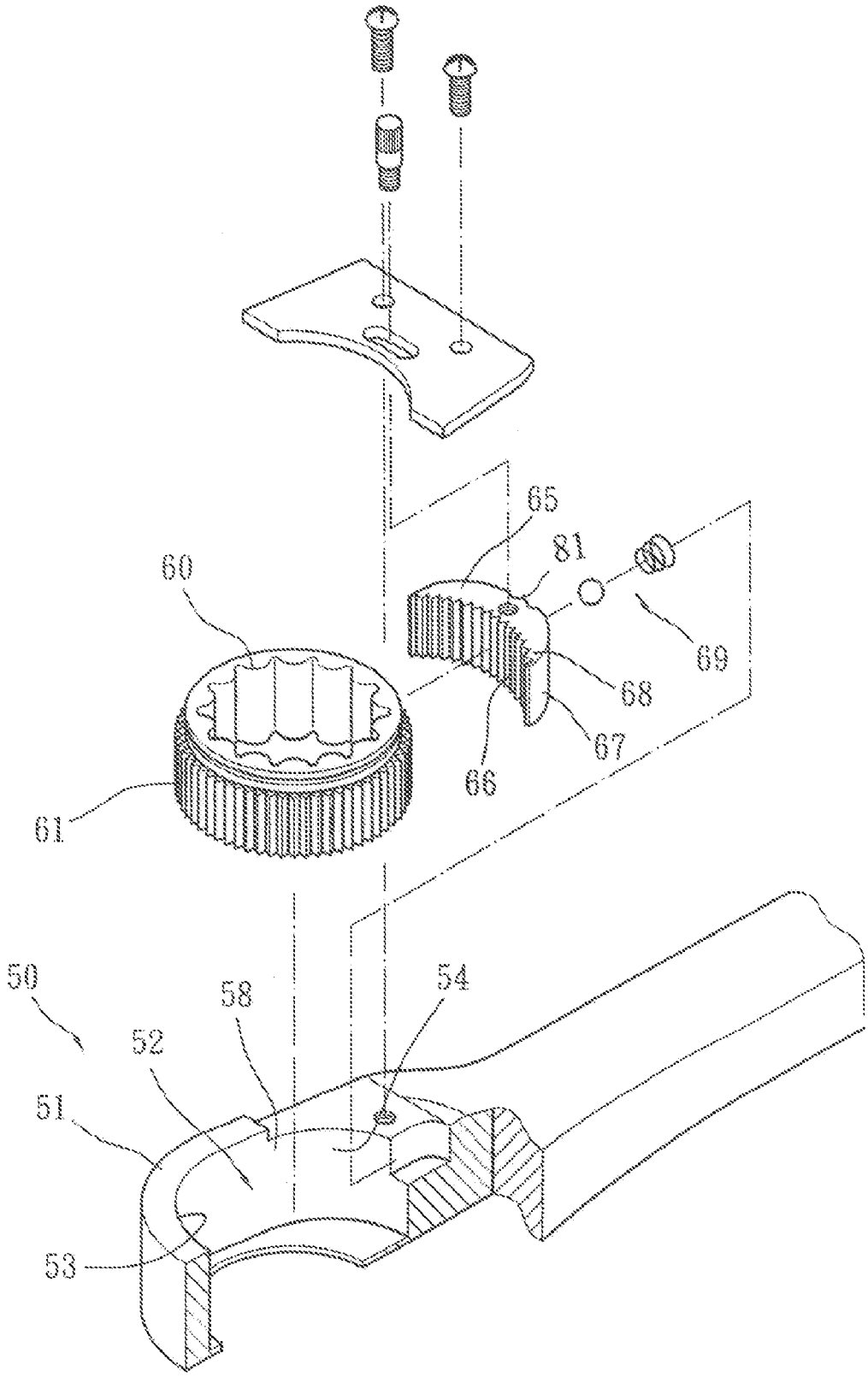
FIG. 3 is an exploded view of the present invention.

Referring to FIG. 3, the ratchet device 50 according to the present invention comprises a head portion 51, a socket member 60 and a ratchet member 65. The head portion 51 is formed with a space 52 which is composed of a first recess 53 for receiving the socket member 60 and a second recess 54 for receiving the ratchet member 65. The socket member 60 is provided with a plurality of teeth 61 engageable with teeth 66 of the ratchet member 65.

Figure 4:
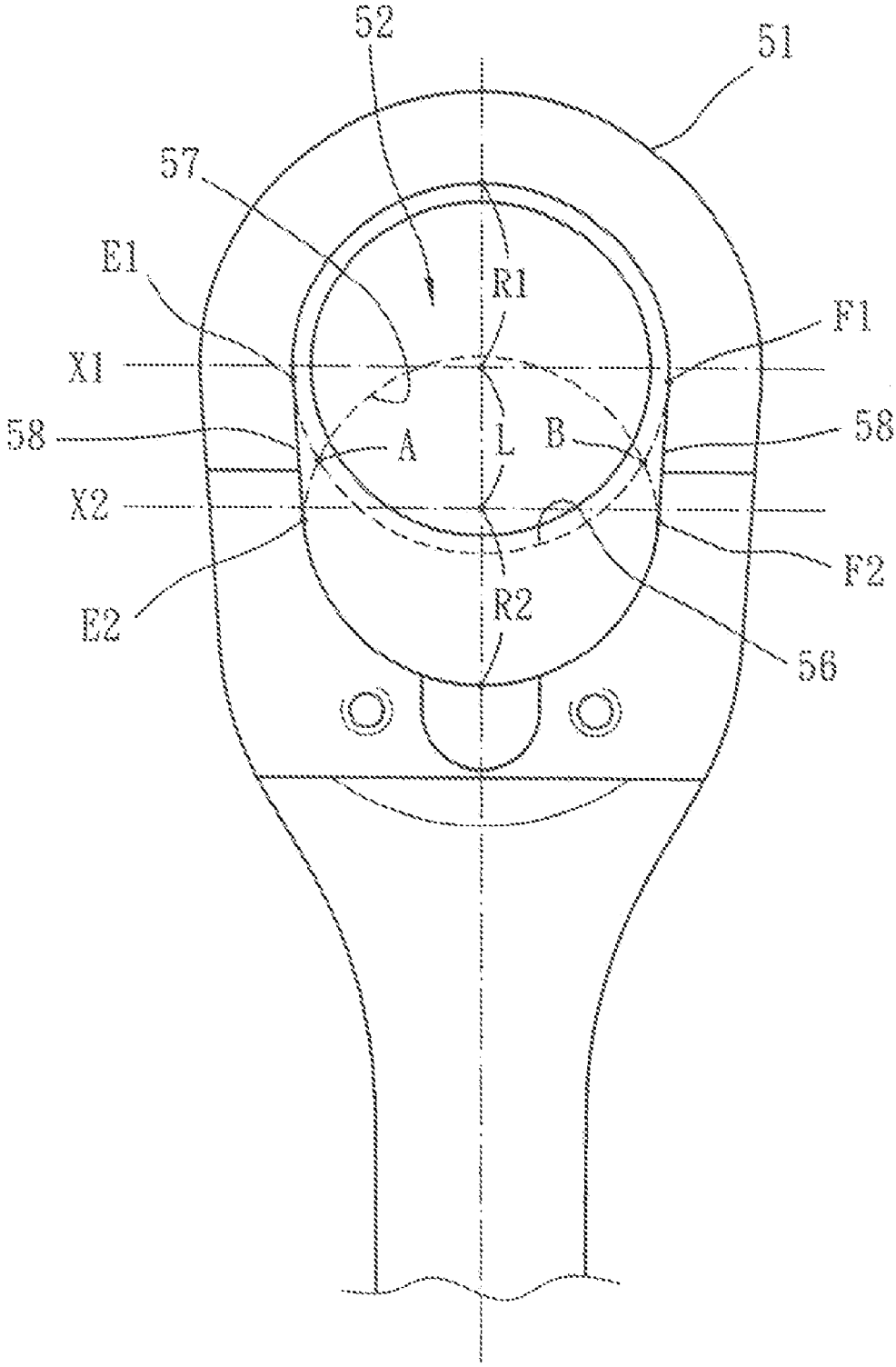
FIG. 4 is a top view showing the structure of the space for receiving the socket member and the ratchet member.
Figure 5:
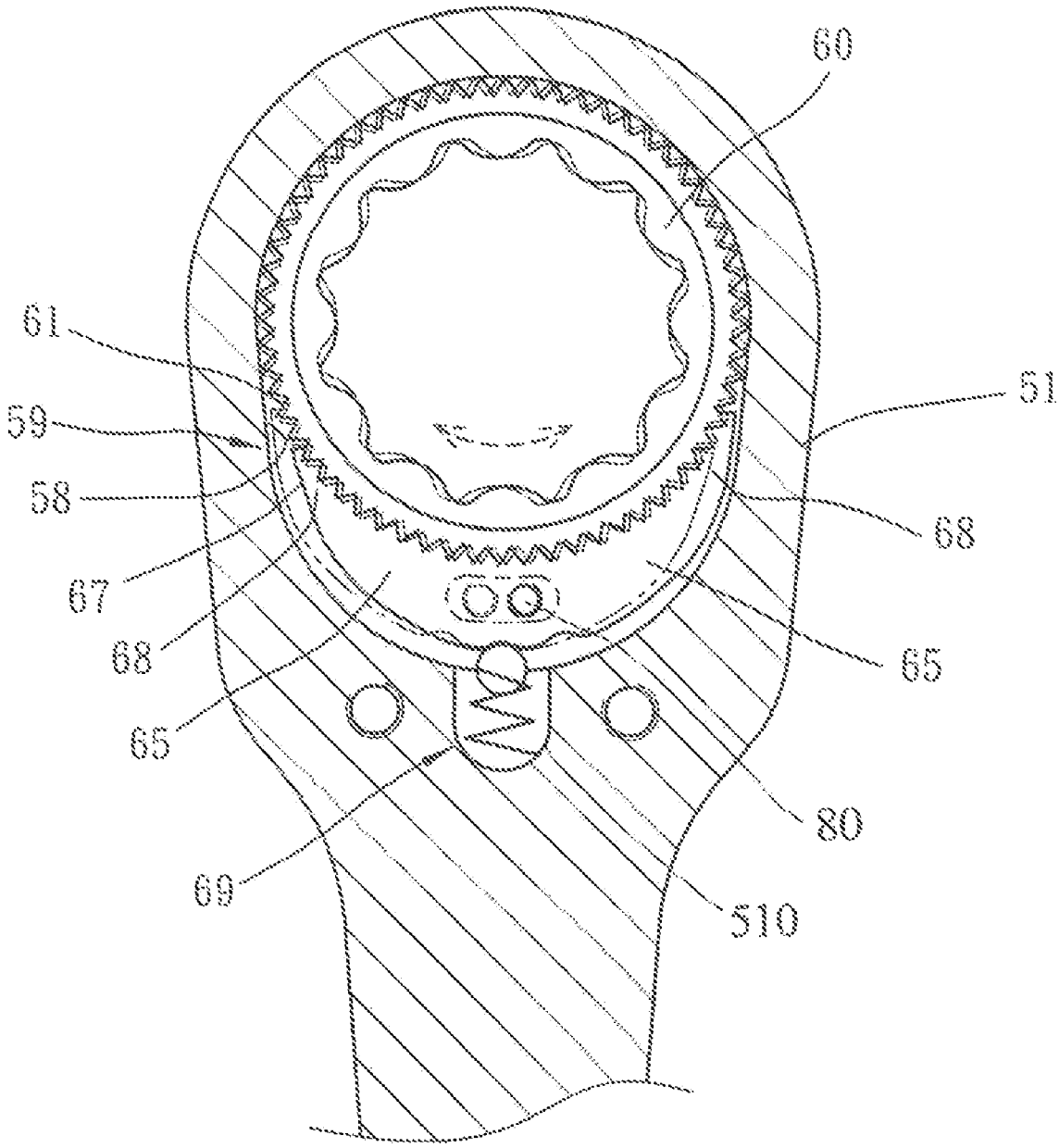
FIG. 5 illustrates the engagement between the socket member and the ratchet member.

As shown in FIGS. 3, 4 and 5, the space 52 is constituted by a first circle 56 with a first radius R1 and a second circle 57 with a second radius R2.

The ratio of R1 to R2 is as follows: R1:R2=1:0.6~1.1

The preferred ratio of R1 to R2 is as follows: R1:R2=1:0.96

The distance between the horizontal center line X1 of the first circle 56 and the horizontal center line X2 of the second circle 57 is equal to L.

The ratio of the first radius of the first circle 56 to the distance L is as follows: R1:L=1:0.6~1.1

The preferred ratio of the first radius of the first circle 56 to the distance L is as follows: R1:L=1:0.76

The first circle 56 intersects the second circle 57 at two points A and B which are located between the two horizontal center lines X1 and X2. The left sides of the first circle 56 and the second circle 57 are connected by a tangent 58 which touches the first circle 56 at a point E2 and the second circle 57 at a point E1. Similarly, the right sides of the first 56 and the second circle 57 are connected by a tangent 58 which touches the first circle 56 at a point F2 and the second circle 57 at a point F1. The tangent 58 may be a straight line or a curved line. Accordingly, the tangent makes an acute angle with respect to a vertical center line passing through the first and second circles 56 and 57 thereby providing an acute angular region 59 between the inner wall of the space 52 and the socket member 60.

The ratchet member 65 is a crescent block which has an outer side and an inner side. The inner side of the ratchet member 65 is provided with a plurality of teeth 66, while the outer side of the ratchet member 65 has a smooth surface. The outer side of the ratchet member 65 is provided at two ends with a contact surface 67. Between the contact surface 67 of the outer side and the teeth 66 of the inner side there is formed a wedge portion 68 adapted to engage with the angular region 59 between the inner wall of the space 52 and the socket member 60. An elastic urging means 69 is mounted in a cavity of the head portion 51 to force the ratchet member 65 against the socket member 60 so that the teeth of the ratchet member 65 are engaged with the teeth of the socket member 60. The top face of the ratchet member 65 is provided with a triggering rod 80 to control the displacement of the ratchet member 65. The outer side of the ratchet member 65 has a plurality of cavities 81 for positioning of a triggering rod 80. The cavity 510 of the head portion 51 is provided with an elastic urging means 69 which pushes against the outer side of the ratchet member 65 for the positioning of the ratchet member 65.

The ratchet member 65 is a crescent block which has an outer side and an inner side. The inner side of the ratchet member 65 is provided with a plurality of teeth 66, while the outer side of the ratchet member 65 has a smooth surface. The outer side of the ratchet member 65 is provided at two ends with a contact surface 67. Between the contact surface 67 of the outer side and the teeth 66 of the inner side there is formed a wedge portion 68 adapted to engage with the angular region 59 between the inner wall of the space 52 and the socket member 60. An elastic urging means 69 is mounted in a cavity of the head portion 51 to force the ratchet member 65 against the socket member 60 so that the ratchet member 65 is threadedly engaged with the socket member 60. The top face of the ratchet member 65 is provided with a triggering rod 80 to control the displacement of the ratchet member 65. The outer side of the ratchet member 65 has a plurality of cavities 81 for positioning of a triggering rod 80. The cavity 510 of the head body 31 is provided with an elastic urging means 69 which pushes against the outer side of the ratchet member 65 for the positioning of the ratchet member 65.

Figure 6:
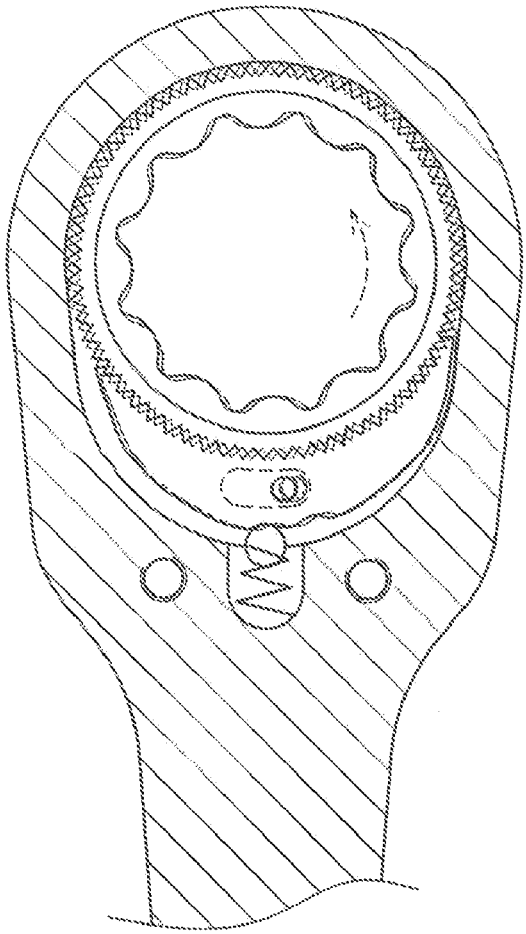
FIG. 6 illustrates how the wedge portion of the ratchet member is closely fitted in the angular region between the inner wall of the space and the socket member.
Figure 7:
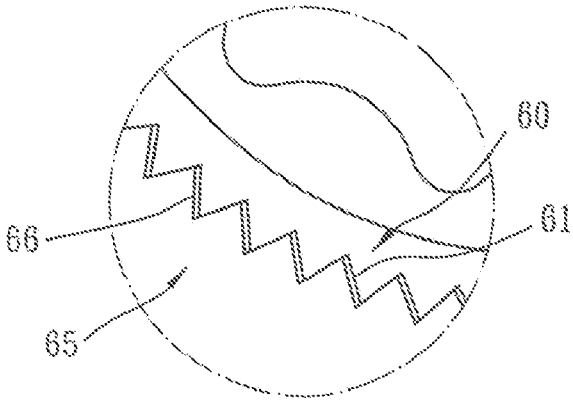
FIG. 7 is an enlarged view showing the engagement between the teeth of the socket member and the teeth of the ratchet member.

When in use, the ratchet device according to the present invention has the following advantages (see FIGS. 5, 6 and 7):

1. Increasing the torsional force:

When the ratchet member 65 is moved sideward by the triggering rod 80, the wedge portion 68 of the ratchet member 65 will be forced into the angular region 59 between the inner wall of the space 52 and the socket member 60 so that the teeth of the ratchet member 65 will fully engage with the teeth of the socket member 60 and the contact surface of the ratchet member 65 will closely about against the tangential surface 58 of the space 42 thereby evenly distributing torsional force on the teeth 66 of the ratchet member 65 and the contact surface 58 and therefore largely increasing the ability to withstand torsional force.

2. Reliability:

When the socket member 60 is rotated, the wedge portion 68 of the ratchet member 65 will be driven by the teeth 61 of the socket member 60 thereby making the wedge portion 69 closely engaged with the angular region 59 of the space 52 and therefore eliminating the clearance between the teeth 61 of the socket member 60 and the teeth 66 of the ratchet member 65. As a consequence, the ability to withstand torsional force will be further increased and slippage between the ratchet member 65 and the socket member 60 can be prevented thus making it more reliable in operation.

3. Durability:

As the socket member 60 is rotated, the clearance between the teeth 61 of the ratchet member 65 and the teeth 66 of the socket member 60 can be effectively reduced and so the teeth 61 of the ratchet member 65 can be fully engaged with the teeth 66 of the socket member 60, thereby preventing slippage between the ratchet member 65 and the socket member 60 can be prevented thus making it more reliable in operation and therefore prolonging the service life.

4. Low cost:

As the socket member 60 is rotated in operation, the wedge portion 69 of the ratchet 65 will be further engaged with the angular region 59 of the space 52 thereby providing a function of automatic compensation. Hence, it is unnecessary to provide component parts with very precise dimensions and so the manufacturing cost can be significantly reduced.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A torsional force structure of a ratchet device comprising:

a body having a head portion at the end of said body, said body having a space which is composed of a first recess and a second recess, said space being constituted by a first circle and a second circle, a horizontal center line of said first circle having a distance from a horizontal center line of said second circle, said first circle intersecting said second circle at two points which are located between said horizontal center lines of said first and said second circles, both sides of said first and second circles being connected by a tangent which forms an acute angular region between an inner wall of said space and a socket member;

a socket member fitted in said first recess and having a plurality of teeth;

a ratchet member fitted in said second recess, said ratchet member being a crescent block having an outer side and an inner side, said outer side of said ratchet member having a plurality of cavities for positioning of a triggering rod, said inner side of said ratchet member having a plurality of teeth engageable with said teeth of said socket member, said ratchet member being provided at two ends thereof with two wedge portions configured to be fitted in said angular region between said inner wall of said space and said socket member;

an elastic urging means mounted in said space pushing said ratchet member against said socket member thereby engaging said ratchet member with said socket member;

said triggering rod being engaged with a top face of said ratchet member for moving said ratchet member;

whereby when said triggering rod is first adjusted to move said ratchet member to make one of said wedge portions of said ratchet member fit in said angular region and the said socket member is rotated, said wedge portion of said ratchet member will be forced to be lightly fitted in said angular region thereby enabling said socket member to provide a positive rotating force.

2. The torsional force structure of a ratchet device as claimed in claim 1, wherein ratio of a radius of said first circle to a radius of said second circle is as follows: 1:0.6~1.1, and ratio of said radius of said first cycle to said distance between said horizontal center line of said first cycle and said horizontal center line of said second cycle is as follows: 1:0.6~1.1.

3. The torsional force structure of a ratchet device as claimed in claim 1, wherein ratio of a radius of said first cycle to a radius of said radius of said second cycled is as follows: 1:0.96, and ratio of said radius of said first cycle to said distance between said horizontal center line of said first cycle and said horizontal center line of said second cycle is as follows: 1:0.76.

4. The torsional force structure of a ratchet device as claimed in claim 1, wherein said tangent is a curved line.

5. The torsional force structure of a ratchet device as claimed in claim 1, wherein said tangent is a straight line.

* * * * *